United States Patent [19]

Johnson et al.

[11] Patent Number: 4,578,031

[45] Date of Patent: Mar. 25, 1986

[54] DIMENSIONALLY STABLE MOVABLE FURNACE HEARTH

[75] Inventors: Keith A. Johnson, Toledo; Vijay M. Kamlani, Maumee, Ohio

[73] Assignee: Midland-Ross Corporation, Cleveland, Ohio

[21] Appl. No.: 669,682

[22] Filed: Nov. 9, 1984

[51] Int. Cl.[4] ..... F27B 9/16; F27D 3/12; F27D 23/00; F27D 1/00

[52] U.S. Cl. ..... 432/138; 432/241; 432/249; 432/251

[58] Field of Search ..... 432/137, 138, 241, 249, 432/251

[56] References Cited

U.S. PATENT DOCUMENTS

| | | | |
|---|---|---|---|
| 1,824,917 | 9/1931 | Morris | 432/241 |
| 2,074,662 | 3/1937 | McLay | 432/138 |
| 3,378,242 | 4/1968 | Cone et al. | 432/138 |

FOREIGN PATENT DOCUMENTS

| | | | |
|---|---|---|---|
| 158424 | 1/1983 | Fed. Rep. of Germany | 432/249 |

*Primary Examiner*—John J. Camby
*Attorney, Agent, or Firm*—H. Duane Switzer

[57] ABSTRACT

An upper furnace portion (A) includes side walls (12, 14) extending along its lower edge. A dimensionally stable furnace hearth (B) is movably mounted adjacent the furnace lower edge and is displaced a small distance from the side walls, such that the hearth is movable without engaging the side walls, yet sufficiently close that relatively little heat tends to pass between the hearth and the side walls. The hearth includes a metal base plate (20) to which a plurality of vertically extending anchoring plates (26) are connected and supported by gussets (30). A plurality of wires (28) are welded to the anchoring plates and extend into peripheral refractory elements (24) which are integrally molded to the wires and the anchoring plates. A plurality of refractory slabs (34) and bricks (36) are supported by the base plate and are disposed within an area defined by the peripheral refractory elements to define a workpiece supporting surface. A plurality of expansion joints (32) permit the peripheral refractory elements to be constrained against outward or radial movement, and a plurality of expansion joints (32) accommodate circumferential or longitudinal expansion. Further expansion joints (38, 40) extend within the peripheral refractory elements and through the refractory slabs and bricks (34, 36) to permit thermal expansion thereof.

18 Claims, 4 Drawing Figures

DIMENSIONALLY STABLE MOVABLE FURNACE HEARTH

BACKGROUND OF THE INVENTION

The present invention relates to the furnace and refractory construction arts. The invention finds particular application in conjunction with rotary and carbottom furnaces, and will be described with particular reference thereto. However, it is to be appreciated that the invention may find application in other fields in which thermal stability is advantageous.

Heretofore, furnaces have been constructed with movable hearths to facilitate the loading and unloading of workpieces for heat treatment. To avoid excessive thermal loss, close tolerances in the spacing between the side walls of the furnace and the outer edges of the movable hearth were advantageous. However, the relatively high temperature gradients and temperatures of the furnace environment caused thermal expansion of the hearth. If the tolerances between the hearth and side walls were too small, they would detrimentally interact or even lock.

The present invention contemplates a new and improved hearth construction which overcomes the above-referenced dimensional stability problems and others.

SUMMARY OF THE INVENTION

In accordance with the present invention, a dimensionally stable furnace hearth is provided. The hearth is adapted to be mounted movably adjacent the lower edge of a furnace in displaced relation from the furnace side walls for movement therebetween.

The subject new furnace hearth includes a metal base plate having peripheral edges. A plurality of metal anchoring plates extend upwardly from the base plate and are disposed adjacent the peripheral edges thereof. A plurality of peripheral refractory elements are disposed adjacent the base plate peripheral edges and fixedly secured to the anchoring plates for restraining outward movement thereof toward the furnace side walls. In this manner, thermal expansion induced physical interaction between the hearth and the furnace side walls is inhibited.

A primary advantage of the invention is the provision of an improved hearth construction having dimensional stability under extreme thermal conditions.

Another advantage of the invention resides in increases in hearth and furnace life and decreases in repairs and maintenance.

Yet another advantage of the present invention is a reduction in heat loss during furnace operation by enabling the hearth and furnace walls to be dimensioned with closer tolerances.

Still other advantages and benefits of the invention will become apparent upon a reading and understanding of the following detailed description.

BRIEF DESCRIPTION OF THE DRAWINGS

The invention may take form in various parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
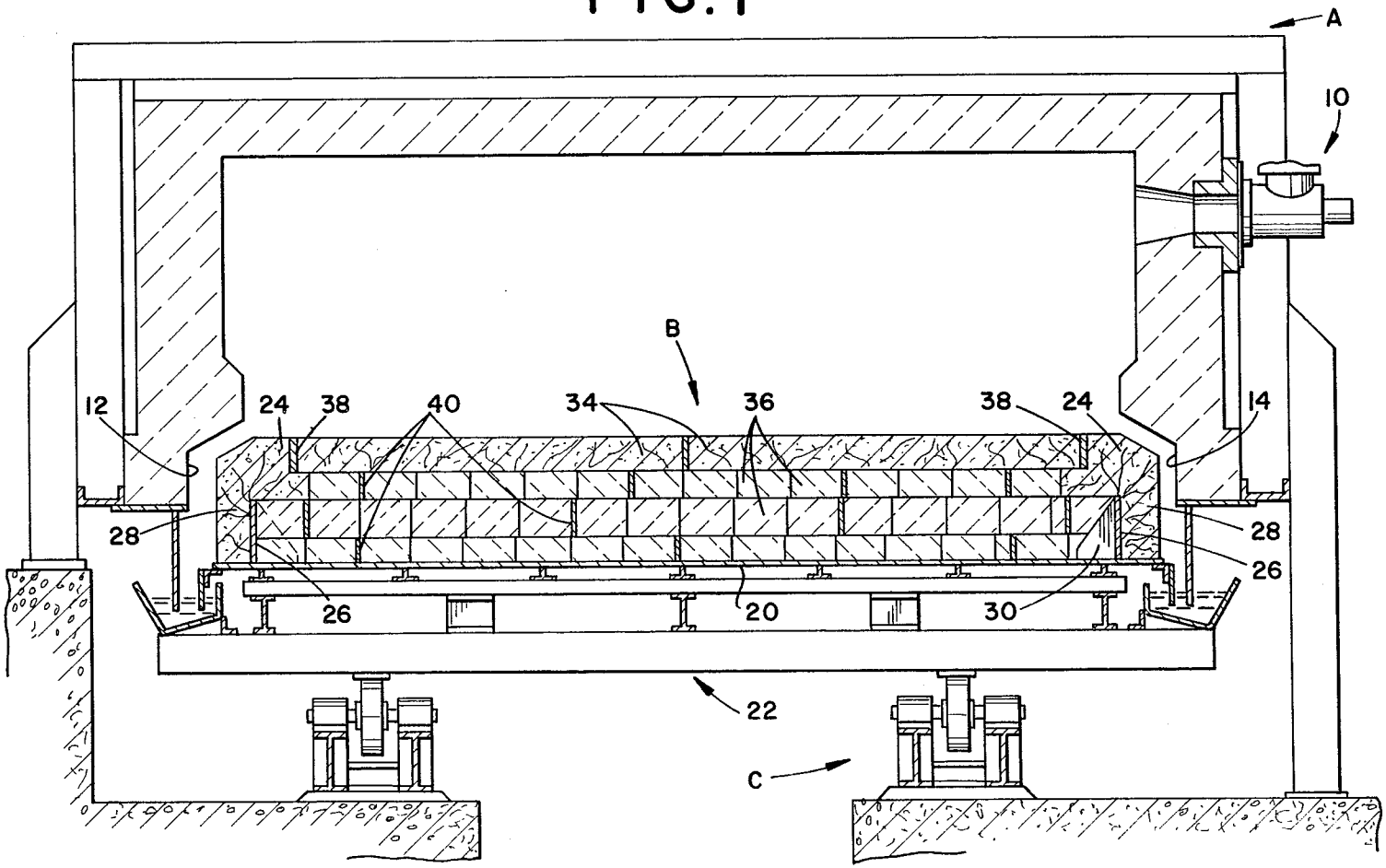
FIG. 1 is a cross-sectional view of one side of a rotary hearth furnace formed in accordance with the present invention.

Referring now to the drawings wherein the showings are for purposes of illustrating preferred embodiments of the invention only and not for purposes of limiting same, FIG. 1 shows an upper furnace portion A defining the upper portion of a heated furnace chamber which is heated by one or more burners 10. The upper furnace portion includes spaced apart side walls 12, 14 adjacent a lower edge thereof which receive a dimensionally stable hearth B therebetween. The hearth is supported by a hearth moving means C for selectively producing relative movement between the hearth and upper furnace portion.

Figure 2:
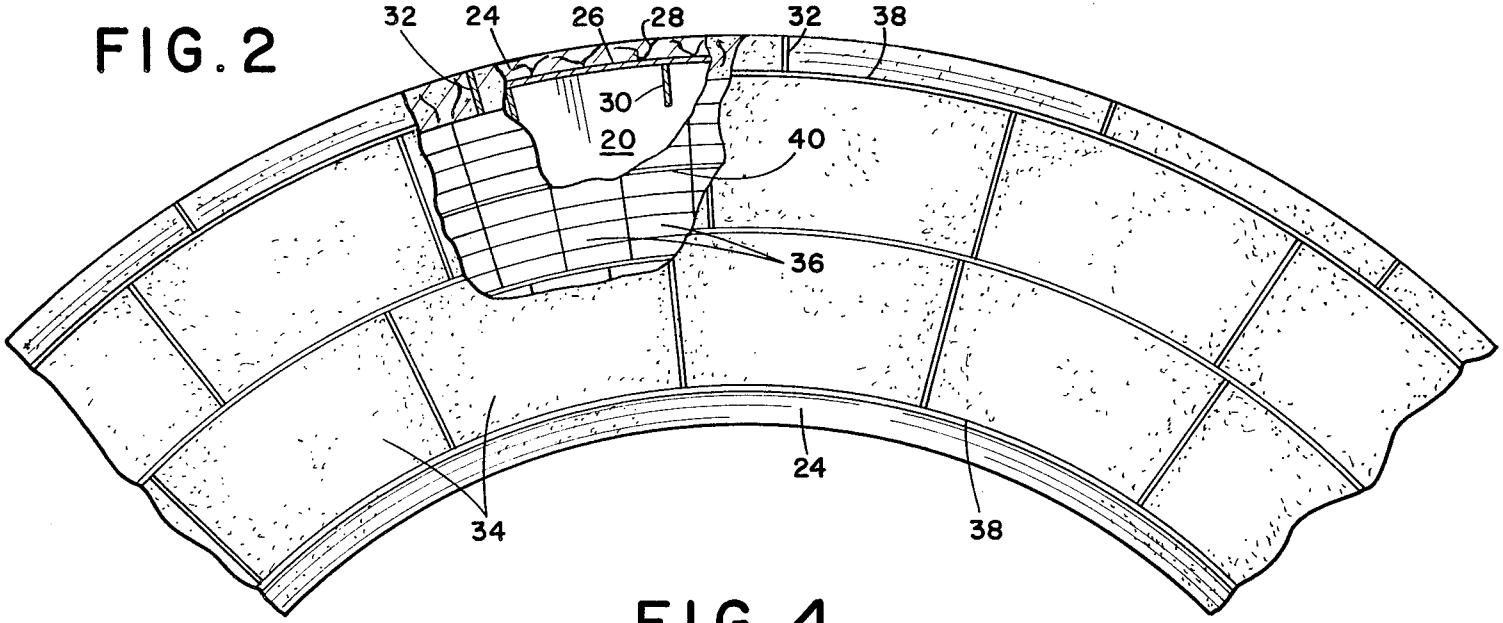
FIG. 2 is a plan view in partial cross-section of about one quadrant of the movable hearth of the FIG. 1 furnace.

With reference to both of FIGS. 1 and 2, the hearth B includes a metal base plate 20 which is supported on a suitable understructure 22. A plurality of peripheral refractory elements 24 are disposed along the peripheral edges of the base plate 20. An attaching means secures the peripheral refractory elements to a plurality of peripheral metal anchoring plates 26 disposed adjacent the base plate peripheral edges. More specific to the preferred embodiment, the attaching means includes a plurality of metal elements, such as wires 28, which are welded or otherwise affixed to the anchoring plates and extend outwardly therefrom into the peripheral refractory elements. The peripheral refractory elements are each molded to one or more of the anchoring plates, and the outwardly extending wires form an integral structure therewith. A plurality of gussets 30 are welded between the anchoring plates and the base plate to ensure a secure interconnection therebetween.

The anchoring plates 26 inhibit outward movement of the refractory elements 24 toward the furnace side walls 12, 14. To accommodate thermal expansion of the peripheral refractory elements, longitudinal expansion joints, such as refractory fiber pads 32, are disposed between adjacent or adjoining peripheral refractory elements (FIG. 2). Specifically, these expansion joints permit longitudinal or circumferential expansion of the refractory elements. A plurality of refractory slabs and bricks 34, 36 are supported on the base plate 20 and disposed between the peripheral refractory elements 24 to define a support surface for workpieces to be heated.

More specific to the embodiment of FIGS. 1 and 2, refractory slabs 34 define a top surface of the hearth and several layers of refractory bricks 36 are disposed thereunder to insulate the base plate from the furnace heat. Inward or radial expansion joints 38 extend peripherally along an inner edge of the peripheral refractory elements 24 and, optionally, at intermediate areas therebetween. The inward expansion joints are compressed with inward and outward radial expansion of the refractory slabs 34 and with inward expansion of peripheral refractory elements 24. Additional expansion joints 40 may be disposed in the underlying layers of refractory bricks 36. In this manner, the hearth and the refractory components thereof are permitted to expand toward the center and circumferentially. However, outward radial expansion of the periphery is constrained, and thus provides dimensional stability to the hearth.

Figure 4:
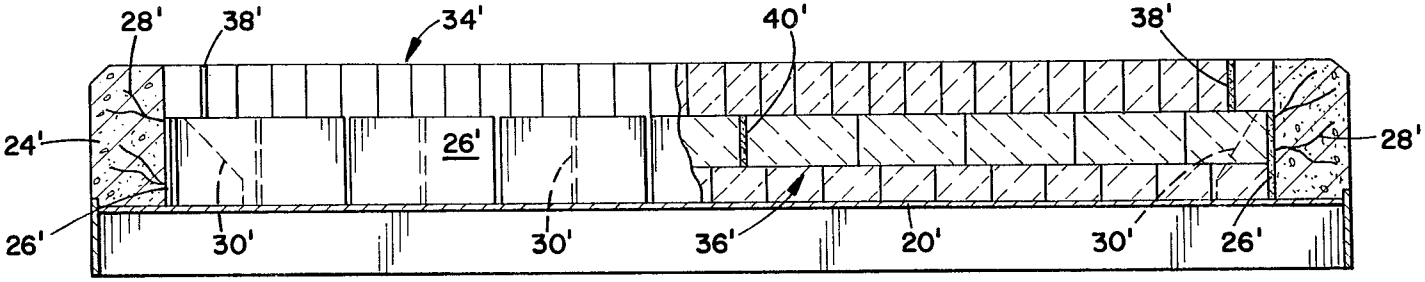
Figure 3:
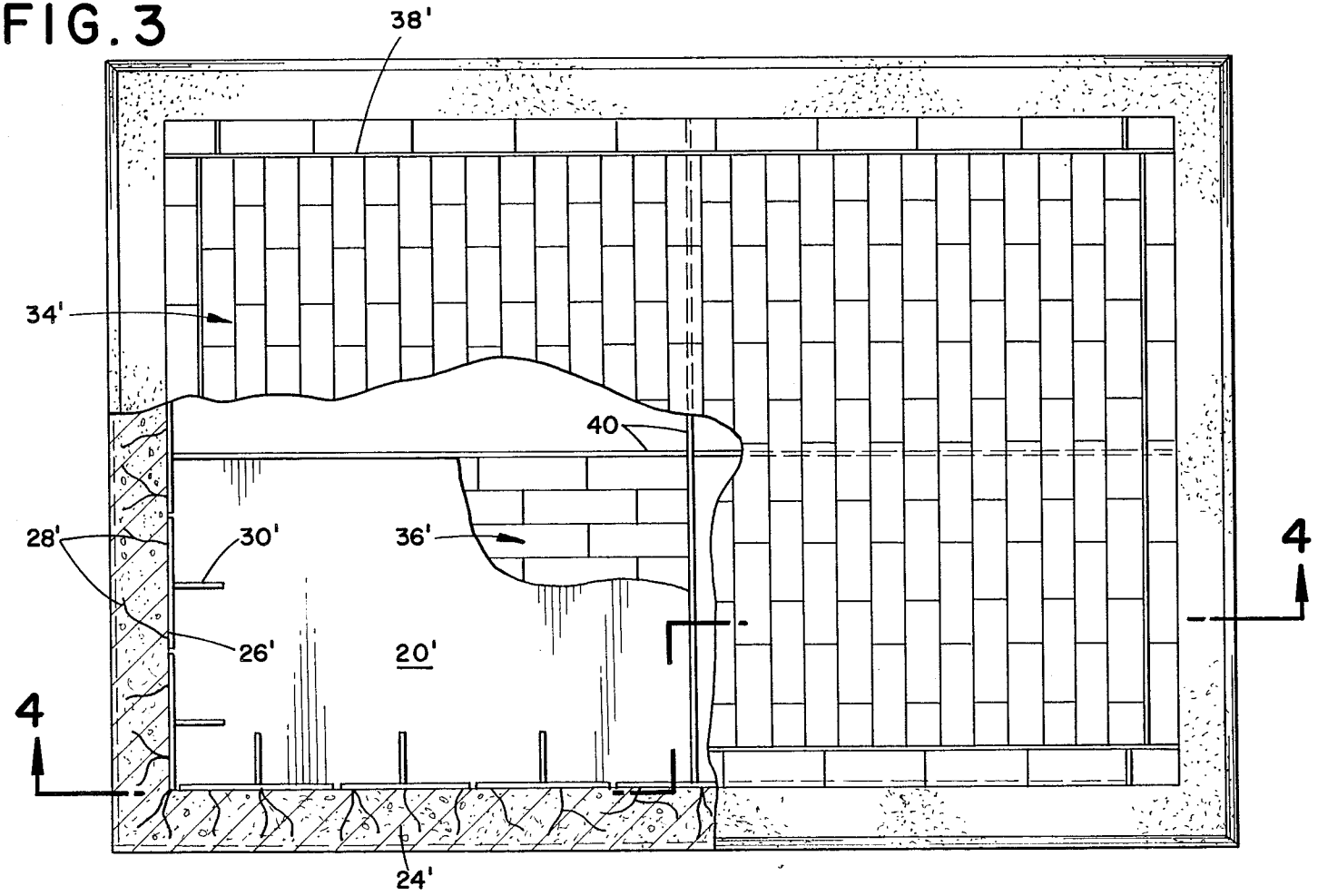
FIG. 3 is a plan view in partial cross-section of a carbottom hearth formed in accordance with the present invention; and, FIG. 4 is a cross-sectional view taken along lines 4—4 of FIG. 3.

FIGS. 3 and 4 illustrate another preferred embodiment of the present invention in which the hearth moves longitudinally into and out of the oven, i.e., a carbottom hearth. In this embodiment, like components are identified by like numerals with a primed (') suffix and new components are identified by new numerals.

The hearth includes a metal bottom plate 20' with one or more peripheral refractory elements 24' mounted around its outer peripheral edge. A plurality of metal anchoring plates 26' with wires 28' are unitarily molded with the peripheral refractory elements 24' to form a one-piece construction therewith. The anchoring plates 26' and a plurality of supporting metal gussets 30' are welded or otherwise affixed to the metal base plate. Refractory slabs or bricks 34', 36' are supported by the base plate 20' and are confined between the peripheral refractory elements 24' to define a workpiece supporting surface. Inward expansion joints 38', such as refractory fiber pads, allow the refractory slabs and the peripheral refractory elements to expand toward the central portion of the hearth without causing expansion of the external peripheral dimensions.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A movable hearth furnace comprising:

an upper furnace portion defining a furnace chamber, the upper furnace portion including spaced apart side walls extending adjacent a lower furnace edge;

at least one burner for supplying heat to the furnace chamber;

a furnace hearth movably mounted adjacent the lower furnace edge and displaced from the side walls for movement therebetween, the movable hearth including:

a metal base plate, a plurality of metal anchoring plates extending upwardly from the base plate and disposed adjacent the periphery thereof, a plurality of peripheral refractory elements exteriorally anchored to the anchoring plates for inhibiting outward movement toward the furnace side walls and promoting dimensional stability of the hearth, whereby the dimensional stability inhibits thermal expansion induced physical interaction between the hearth and furnace side walls; and, means for accommodating selective movement of the hearth relative to the upper furnace portion.

2. The furnace as set forth in claim 1 further including an anchoring plate to refractory element attaching means for fixedly interconnecting the anchoring plates with the peripheral refractory elements.

3. The furnace as set forth in claim 2 wherein the refractory elements are molded to the anchoring plates.

4. The furnace as set forth in claim 3 wherein the anchoring means includes metal elements which are connected to the anchoring plates and extend into the peripheral refractory elements.

5. The furnace as set forth in claim 4 wherein the metal elements are wires which are welded to the anchoring plates.

6. The furnace as set forth in claim 1 further including gussets interconnected with the anchoring plates and the base plate.

7. The furnace as set forth in claim 1 further including at least a first expansion joint extending peripherally adjacent an inwardly facing surface of the peripheral refractory elements.

8. The furnace as set forth in claim 7 further including a plurality of longitudinal expansion joints interposed between adjacent peripheral refractory elements to accommodate longitudinal extension thereof.

9. The furnace as set forth in claim 1 further including a plurality of longitudinal expansion joints interposed between adjacent peripheral refractory elements to accommodate longitudinal extension thereof.

10. A furnace hearth having a dimensionally stable periphery, the furnace hearth comprising:

a base plate;

a plurality of anchoring plates extending upwardly from the base plate adjacent a peripheral edge thereof and disposed generally peripherally therearound;

a plurality of peripheral refractory elements disposed adjacent the base plate peripheral edge and exteriorally anchored to the anchoring plates against outward movement; and, a plurality of refractory members supported by the base plate and disposed within the peripheral refractory elements to define a workpiece supporting surface.

11. The furnace hearth as set forth in claim 10 further including an anchoring plate and refractory element attaching means for interconnecting the anchoring plates with the peripheral refractory elements.

12. The furnace hearth as set forth in claim 11 wherein the peripheral refractory elements are moded to the anchoring plates.

13. The furnace hearth as set forth in claim 12 wherein the attaching means includes metal elements which are connected to the anchoring plates and extend into the peripheral refractory elements.

14. The furnace hearth as set forth in claim 13 wherein the metal elements comprise wires which are fixedly secured to the anchoring plates.

15. The furnace hearth as set forth in claim 10 further including gussets interconnected with the anchoring plates and the base plate.

16. The furnace hearth as set forth in claim 10 further including at least one expansion joint extending peripherally adjacent an inwardly facing surface of the peripheral refractory elements.

17. The furnace hearth as set forth in claim 16 further including a plurality of longitudinal expansion joints interposed between peripheral refractory elements to accommodate longitudinal extension thereof.

18. The furnace hearth as set forth in claim 10 further including a plurality of longitudinal expansion joints interposed between peripheral refractory elements to accommodate longitudinal extension thereof.

* * * * *